US010659889B2

(12) United States Patent
Straeussnigg et al.

(10) Patent No.: US 10,659,889 B2
(45) Date of Patent: May 19, 2020

(54) MICROPHONE PACKAGE AND METHOD FOR GENERATING A MICROPHONE SIGNAL

(71) Applicant: Infineon Technologies AG, Neubiberg (DE)

(72) Inventors: Dietmar Straeussnigg, Villach (AT); Andreas Wiesbauer, Poertschach (AT)

(73) Assignee: Infineon Technologies AG, Neubiberg (DE)

( * ) Notice: Subject to any disclaimer, the term of this patent is extended or adjusted under 35 U.S.C. 154(b) by 0 days.

(21) Appl. No.: 14/075,225

(22) Filed: Nov. 8, 2013

(65) Prior Publication Data

US 2015/0131819 A1 May 14, 2015

(51) Int. Cl.
*H04R 19/00* (2006.01)
*H04R 1/04* (2006.01)

(52) U.S. Cl.
CPC ..... *H04R 19/005* (2013.01); *H04R 1/04* (2013.01)

(58) Field of Classification Search
CPC . H04R 19/04; H04R 3/00; H04R 1/00; H04R 1/005; H04R 1/222; H04R 1/24; H04R 1/26; H04R 2410/07; H04R 2201/003; H04R 19/005; H04R 19/01; H04R 7/14; H04R 17/02; H04R 25/407; H04R 29/006; H04R 1/086; B81B 7/0032; B81C 1/0023; H04M 1/03; G11B 20/1004; H03G 3/301
See application file for complete search history.

(56) References Cited

U.S. PATENT DOCUMENTS 4,688,258 A * 8/1987 Kunugi et al. ..... 381/103
5,710,823 A 1/1998 Nagata et al.
5,881,103 A * 3/1999 Wong ..... H03G 5/16 375/229
5,923,422 A * 7/1999 Keens ..... G01J 3/45 356/451
6,101,258 A * 8/2000 Killion ..... H04R 25/407 381/313
6,639,987 B2 * 10/2003 McIntosh ..... H03G 5/005 381/71.6
7,190,800 B2 3/2007 Terada et al.
8,223,981 B2 * 7/2012 Haila ..... H04R 3/005 381/57
8,416,659 B1 * 4/2013 Xie ..... G11B 20/10037 369/47.17

(Continued)

FOREIGN PATENT DOCUMENTS

CN 1874617 A 12/2006
DE 102014100985 A1 8/2014
JP 2009238086 A 10/2009

OTHER PUBLICATIONS

"STSmartVoice Demonstration Board Based on MP34DT01"; STEVAL-MKI126V3; DocID023685 Rev. 2, Jun. 2013, p. 1-9.

(Continued)

*Primary Examiner* — Fan S Tsang
*Assistant Examiner* — Angelica M McKinney
(74) *Attorney, Agent, or Firm* — Eschweiler & Potashnik, LLC

(57) ABSTRACT

A microphone package for providing a modified microphone signal includes a microphone and an equalizer device coupled to the microphone.

23 Claims, 5 Drawing Sheets

(56) References Cited

U.S. PATENT DOCUMENTS 8,842,033 B1* 9/2014 Abramzon ..... H03M 1/0626 341/144
2002/0057815 A1* 5/2002 Killion ..... H04R 25/407 381/313
2002/0071573 A1* 6/2002 Finn ..... G10L 21/0208 381/93
2003/0053646 A1* 3/2003 Nielsen ..... H04R 29/006 381/312
2005/0013455 A1* 1/2005 Loeb et al. ..... 381/191
2006/0206320 A1* 9/2006 Li ..... G10L 21/0208 704/226
2007/0064968 A1* 3/2007 Weigold ..... 381/369
2008/0037768 A1* 2/2008 Hsu ..... H04M 1/03 379/429
2008/0075309 A1 3/2008 Chen et al.
2008/0205668 A1* 8/2008 Torii ..... H04R 1/326 381/113
2008/0298621 A1* 12/2008 Theuss ..... B81C 1/0023 381/360
2010/0017205 A1* 1/2010 Visser ..... G10L 21/02 704/225
2010/0142725 A1* 6/2010 Goldstein ..... H04R 29/00 381/92
2012/0155667 A1* 6/2012 Nair ..... G10K 11/178 381/71.6
2012/0319256 A1* 12/2012 Lo ..... B81B 7/0061 257/666
2013/0064042 A1* 3/2013 Aarts et al. ..... 367/99
2013/0163748 A1* 6/2013 Khanduri ..... H04M 9/082 379/406.08
2014/0198932 A1* 7/2014 Parkins ..... H04R 1/086 381/189
2014/0264652 A1* 9/2014 Cagdaser et al. ..... 257/416
2014/0286385 A1* 9/2014 Wilson ..... G11B 20/10046 375/232
2014/0294218 A1* 10/2014 Suvanto ..... H04M 1/03 381/337
2014/0307884 A1* 10/2014 Asada ..... G10K 11/178 381/71.6
2014/0334643 A1* 11/2014 Pinna ..... H03G 3/301 381/107
2015/0195059 A1* 7/2015 Strau nigg ..... H04B 1/0483 375/295
2019/0306617 A1* 10/2019 Straeussnigg ..... H04R 3/00

OTHER PUBLICATIONS

"Scalable Digital Microphone Processor"; STA321MP; DocID022647 Rev. 4, May 2013, p. 1-84.
De Chen, Peihua Shen; "DJS-130 Computer Data Sampling and Processing System"; Book; Sep. 1984 (translation and original included).

* cited by examiner

MICROPHONE PACKAGE AND METHOD FOR GENERATING A MICROPHONE SIGNAL

FIELD

Embodiments relate to a microphone package for providing a microphone signal and to a method for generating a microphone signal.

BACKGROUND

Microphones are used to record ambient noise or sound. Telecommunication applications often use microphones of small scale. An example for a small-scale microphone is a silicon-microphone or a microphone implemented as a micro-electro-mechanical system (MEMS). In order to provide for a good quality of the recorded sound or to comply with customers' requirements, a high linearity, high signal-to-noise ratios (SNR) or the compliance with a predetermined spectral mask for the response function of a microphone may be required. Some of the aforementioned requirements may be fulfilled by tuning of microphone parameters, such as a free volume behind a sensing membrane, stiffness of the membrane, sound port, etc. Some of the conventional approaches to increase linearity of the response function may reduce the signal-to-noise ratio. However, some applications may require high quality or a good signal-to-noise ratio. Hence, there is a desire to provide microphone packages with enhanced properties.

SUMMARY

According to some embodiments, a microphone and an equalizer device coupled to the microphone are provided within a microphone package.

An audio-processing device according to some embodiments comprises a microphone package for providing a microphone signal, the microphone package comprising a microphone and an equalizer device. The audio processing device further comprises a printed circuit board having a signal terminal connected to a corresponding signal terminal of the microphone package to transfer a microphone signal to the printed circuit board.

BRIEF DESCRIPTION OF THE FIGURES

Some example embodiments of apparatuses and/or methods will be described in the following by way of example only, and with reference to the accompanying figures, in which.

DETAILED DESCRIPTION

Various example embodiments will now be described more fully with reference to the accompanying drawings in which some example embodiments are illustrated. In the figures, the thicknesses of lines, layers and/or regions may be exaggerated for clarity.

Accordingly, while further embodiments are capable of various modifications and alternative forms, some example embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like or similar elements throughout the description of the figures.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular example embodiments only and is not intended to be limiting of further example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Figure 1:
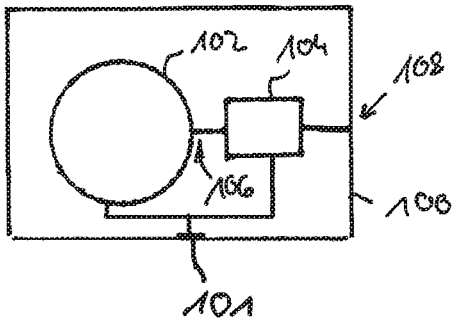
FIG. 1 shows an embodiment of a microphone package.

FIG. 1 shows a conceptual view of an example embodiment of a microphone package 100 which comprises a microphone 102 and an equalizer device 104. The microphone 102 is used to record ambient sound, voice, music or the like and to provide a microphone signal 106. Recording or providing a microphone signal may be understood to provide an electrical signal which is depending on the ambient sound or, in other terms, on the sound pressure acting on the microphone 102. Various types of microphones may be used, for example electret-microphones or other condenser microphones. One particular example is a silicon-microphone implemented as a micro-electro-mechanical system. That is, the membrane and other components constituting the microphone may be manufactured using processing steps and techniques commonly used in microprocessor manufacturing.

Some of the characteristics of the microphone that relate the resultant microphone signal to the acting sound pressure may be tuned by hardware characteristics of the microphone itself, e.g. the back volume or the stiffness of a membrane of the microphone 102. The microphone packages 100 according to example embodiments further comprise an equalizer device 104 to modify the microphone signal 106 to provide a modified microphone signal 108. The modified microphone signal 108 is provided at an output of the microphone package 100.

Some example embodiments use the equalizer device to modify the microphone signal such that a signal-to-noise ratio of the modified microphone signal is decreased as compared to the signal to noise ratio of the microphone signal. This may allow to provide a microphone package providing a signal with enhanced characteristics.

In some example embodiments, the equalizer device is configured to modify the microphone signal such that a resonant component within a frequency response of the microphone signal is reduced. The frequency response and the signal-to-noise ratio of the microphone signal may depend on the package. Example embodiments may therefore provide microphone packages which can be used without the need for further signal processing by the customer even when enhanced signal characteristics are required.

According to some example embodiments, modifying the microphone signal 106 includes attenuating or amplifying first frequency components of the microphone signal 106 with respect to different second frequency components by means of the equalizer device 104.

Some example embodiments use a finite impulse response filter (FIR) within the equalizer device 104. According to some example embodiments, this provides a cost-effective implementation of the equalizer device 104 and allows for an enhancement of a signal characteristic of the microphone signal 108. According to some example embodiments, the finite impulse response filter is of third order. If the response function of the microphone has a resonant characteristic or a resonance peak within the investigated spectrum, an FIR filter having three coefficients may be capable of modeling the inverse of the frequency response of the microphone 102. According to some example embodiments, the coefficients of the FIR filter are programmable or variable. This may serve to maintain the desired filter characteristic when the equalizer device 104 is operated with different sample frequencies in order to support multiple application scenarios by means of a single microphone package 100.

Some example embodiments further comprise an analog-to-digital converter in order to enable processing of the microphone signal 106 within the digital domain. This may increase flexibility of the application, for example supporting multiple sample frequencies for subsequent components.

Some example embodiments comprise an infinite impulse response filter (IIR) within the equalizer device 104. Further example embodiments comprise a low-pass filter within the equalizer device. A low-pass filter may be implemented either as a digital filter or an analog filter.

The modified microphone signal 108 may be provided in arbitrary different representations. For example, a single-bit protocol may be used so that the modified microphone signal is provided as a bit stream. Other implementations may provide the modified microphone signal as a sequence of bytes, e.g. in the hexadecimal or in the decimal system. Further embodiments may provide a modified microphone signal as an analog signal.

Some example embodiments provide a modified microphone signal in single-bit representation and may comprise a modulator to provide the single-bit representation from a multi-bit representation that may be used in preceding processing steps within the microphone package.

A microphone package 100 according to some example embodiments further comprises one or more terminals in order to provide for the possibility to connect all components within the microphone package in one single assembly step to further circuitry, printed circuit boards or the like by means of the terminal(s). Some example embodiments of a microphone package 100 comprise a common housing enclosing the microphone and the equalizer device at least partly, the common housing having supply connectors for electrically connecting all components of the microphone package to further circuitry. A microphone package 100 according to some example embodiments may be understood as a single entity which can be handled as a discrete independent device so that the components within the microphone package can be connected to further devices or circuitry by electrically connecting the microphone package as a whole to the further circuitry. This may allow to reduce the number of terminals used within an application, for example by using a single supply voltage terminal 101 to receive a common supply voltage for the microphone and the equalizer device within the package.

Figure 2:
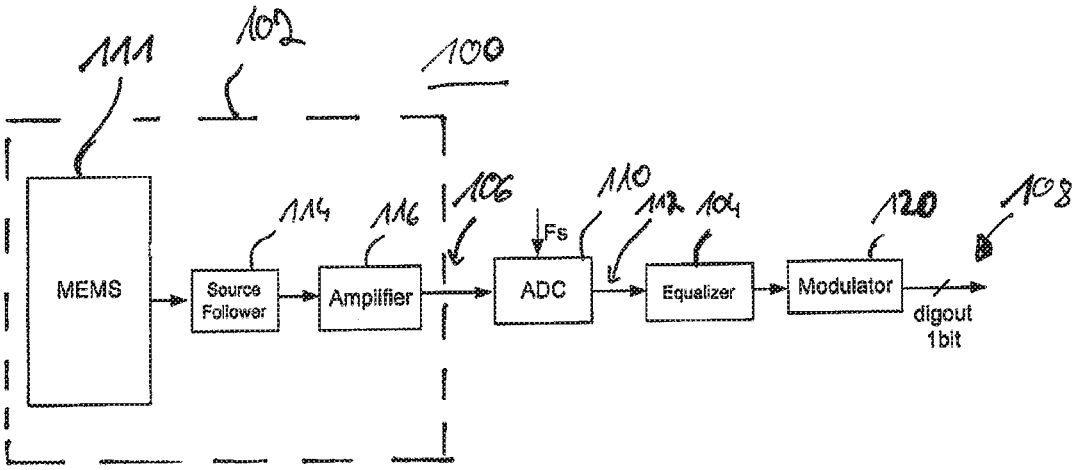
FIG. 2 shows a block diagram of the components of a further embodiment of a microphone package.

FIG. 2 shows a further example embodiment of a microphone package 100 using a MEMS microphone 102 as the microphone to provide the microphone signal 106. In the particular example, the MEMS microphone comprises a transducer 111 implemented as a MEMS device, a source follower 114 and a subsequent amplifier 116 in order to pre-process and pre-amplify a raw signal of the transducer 111 so as to adapt the microphone signal 106 to the dynamic input range of an analog-to-digital converter (ADC) 110. The equalizer device 104 is implemented in one embodiment in the digital domain and the microphone package 100 comprises the analog-to-digital converter 110 in order to provide a digital representation of the microphone signal 112 in the digital domain. In the example illustrated in FIG. 2, the microphone 102 provides an analog microphone signal 106. In further examples, a microphone may provide a digital signal so that the analog-to-digital converter 110 may also be part of the microphone 102. The equalizer device 104 provides the modified microphone signal. In the example embodiment of FIG. 2, the analog-to-digital converter 110 is a multi-bit converter so that the modified microphone signal 108 is a multi-bit representation. A modulator 120 of the microphone package 100 in one embodiment transfers the multi-bit representation into a single-bit representation of the modified microphone signal 108 which is output by the microphone package 100.

It should be noted that the fact that the functional blocks illustrated herein shall not be construed to mean that the corresponding functionality does necessarily have to be implemented in one single piece of hardware or in one single device. Instead, the different functionalities may be distributed to different devices or be implemented in one single device. For example, the source follower 114, the amplifier 116, the analog-to-digital converter 110, the equalizer device 104 and the modulator 120 of FIG. 2 may be implemented in one single ASIC or device in some examples, while the may be implemented using two or more separate devices in other examples.

In the embodiment of FIG. 2, a sample frequency $F_s$ of the analog-to-digital converter 110 is variable so that multiple sample frequencies may be supported by the microphone package 100. According to some example embodiments of microphone packages, a characteristic of the equalizer device 104 is variable which may allow achieving similar modification characteristics of the equalizer device 104 for different sample frequencies of the analog-to-digital converter 110.

Figure 3:
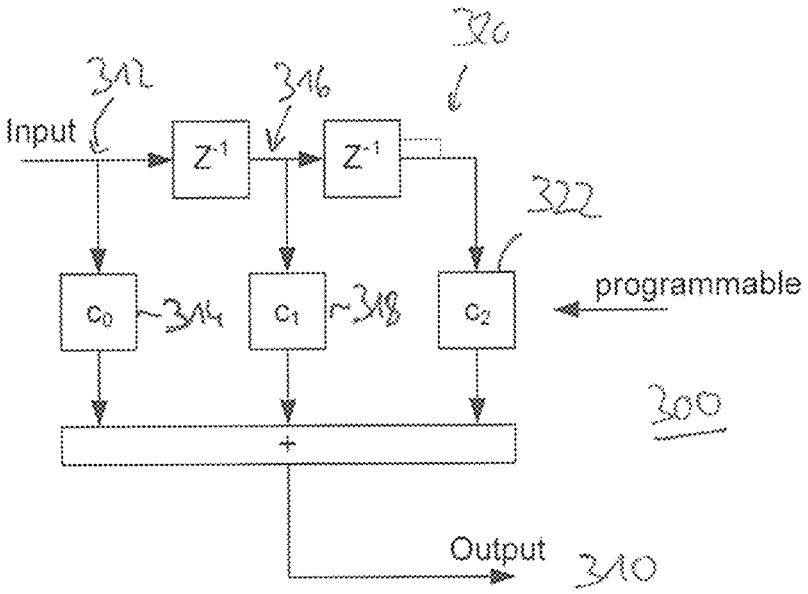
FIG. 3 shows a block diagram of an implementation of an equalizer.

FIG. 3 shows in more detail a finite-impulse-response filter 300 as it may be used in some example embodiments of the equalizer devices 104. The finite-impulse-response filter 300 is operating in the time-discrete digital domain and provides, at each processing step, an output signal 310 depending on the present input signal 312 multiplied by a first scaling parameter ($c_0$) 314. The output signal 310 further depends on the preceding input signal or sample 316 multiplied by an associated second scaling parameter ($c_1$) 318 and on the penultimate input signal 320 multiplied by a third scaling parameter ($c_2$) 322. The output signal 300 is the sum of a scaled input sample 312, a scaled preceding input sample 316 and a scaled penultimate input sample 320.

Figure 4:
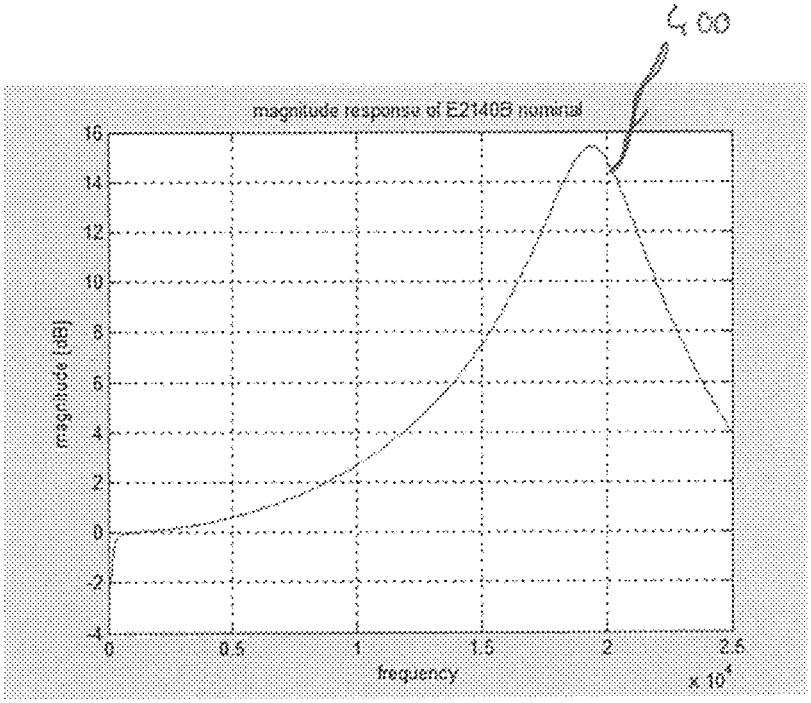
FIG. 4 shows an illustration of the frequency response of a microphone.

FIG. 4 shows a frequency response of a MEMS-microphone as it may be used as a microphone 102 within a microphone package according to an example embodiment. The x-axis shows the frequency in units of ten kHz and the y-axis illustrates the magnitude of the response of the MEMS-microphone in dB. The graph 400 illustrates a significant resonant peak in the useful band which may, for example, range from some tens of Hz to 20 kHz in typical microphone applications.

The strong resonance peak at around 19 kHz leads to a decrease of the signal-to-noise ratio of the microphone signal which may be an undesirable behavior.

Figure 5:
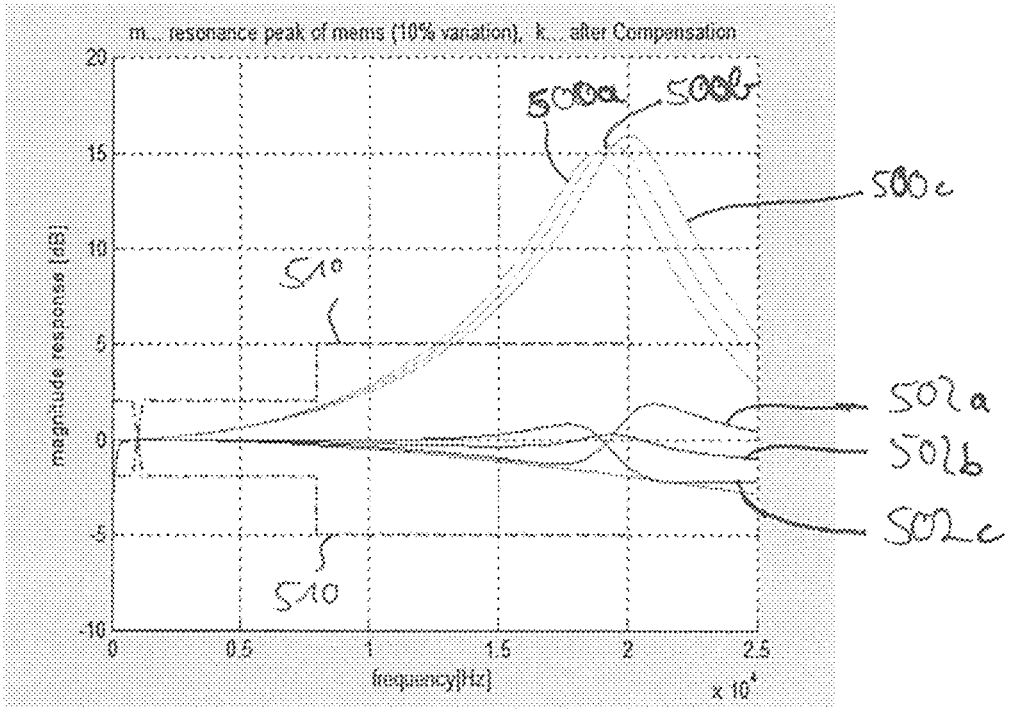
FIG. 5 shows a response function of an embodiment.

FIG. 5 illustrates the frequency response of a modified microphone signal of an example embodiment of a microphone package 100 as compared to the microphone signal provided by the microphone. In particular, three different graphs 500*a*, 500*b* and 500*c* are shown which assume a variation of the frequency response of the microphone signal of the MEMS-microphone by roughly ±10%. A desirable frequency mask 510 is illustrated in broken lines and indicates a frequency response as it is desirable for the particular implementation.

The graphs 502*a*, 502*b* and 502*c* illustrate the frequency responses of the modified microphone signal as achieved by a microphone package according to an example embodiment. In the example embodiment, a finite impulse response filter of third order is used within the equalizer device 104. Although the implementation of a third order FIR filter is economical, FIG. 5 illustrates that even though the characteristics of the MEMS microphones may vary by up to ±10% due to production variations, an FIR filter of third order with identical filter coefficients may be used to flatten the frequency response of the microphone signal so that it fits into the required spectral mask 510. This may decrease the signal-to-noise ratio of the modified microphone signal as provided by the microphone package significantly.

In particular, the example embodiment of a microphone package increases the signal-to-noise ratio of the MEMS-microphone under observation from about 65 dB to 67.2 dB and hence by more than 2 dB. That is, some example embodiments may increase the signal-to-noise ratio by several dB, for example up to 2, 3, 4 or even up to 5 dB and more.

Other example embodiments may increase the signal-to-noise ratio to a lesser extent, still flattening the frequency response of the microphone signal and hence its linearity.

Figure 6:
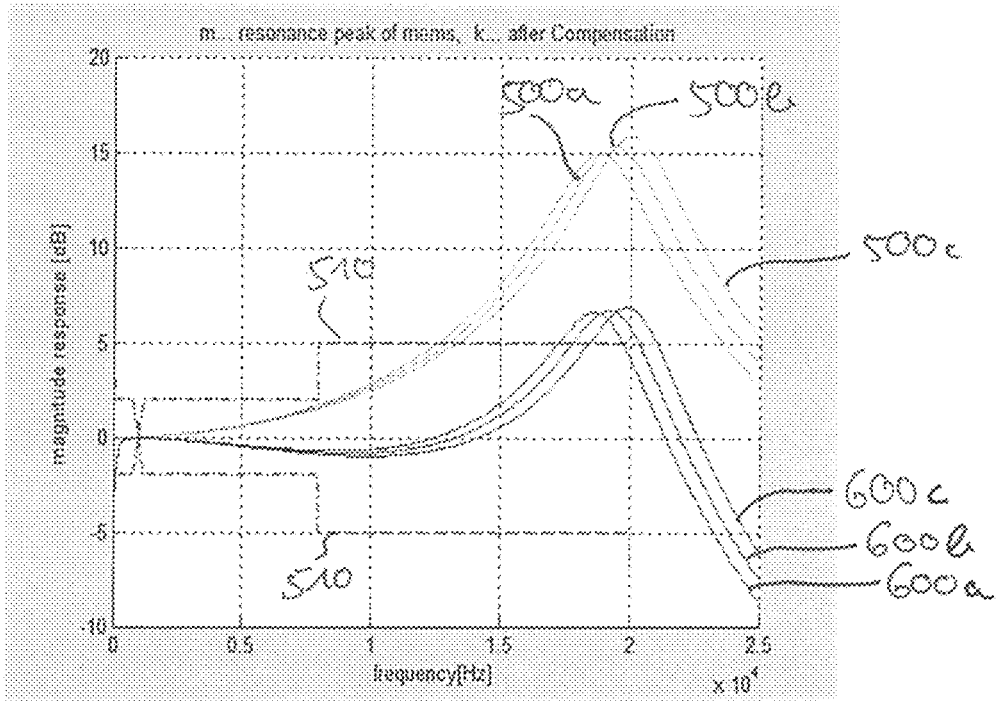
FIG. 6 shows a response function of a further embodiment.

FIG. 6 illustrates the output of a further example embodiment of a microphone package using an equalizer with a low-pass filter. The graphs 500*a* to 500*c* correspond to the graphs of FIG. 5 as well as the spectral mask 510 does. The equalizer of the example embodiment underlying the illustration of FIG. 6 uses a low-pass filter of second order in order to modify the microphone signal in the digital domain. As is apparent from FIG. 6, the frequency responses of the corresponding graphs 600*a* to 600*c* illustrate that the spectral requirement may also be achieved by means of a low-pass filter, which may, for example, be implemented using an IIR-filter. The example embodiment illustrated in FIG. 6 also leads to an increase in the signal-to-noise ratio of the modified microphone signal of the microphone package 100 by 2 dB.

Figure 7:
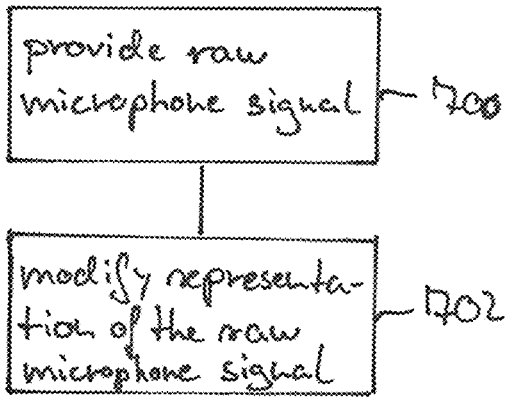
FIG. 7 shows a flowchart of an embodiment of a method for providing a microphone signal in a microphone package.

FIG. 7 shows a flowchart of an embodiment of a method for providing a microphone signal in a microphone package.

The method comprises providing a microphone signal at 700 using a micro-electro-mechanical-system microphone and modifying the microphone signal to provide a modified microphone signal at 702.

Figure 8:
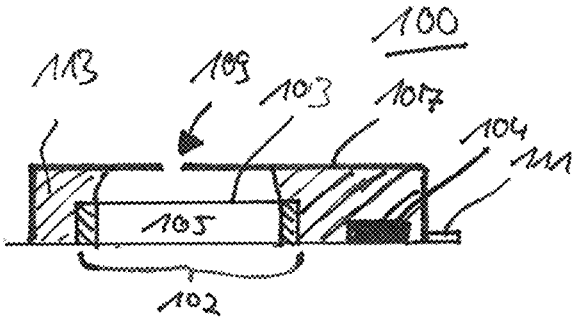
FIG. 8 shows a cross section of an embodiment of a microphone package.

FIG. 8 illustrates a section view of an embodiment of a microphone package 100. The microphone package 100 includes a microphone 102 and an equalizer device 104. The microphone 102 is implemented as a MEMS microphone and comprises a membrane 103 which seals a back volume 105. A cap 107 encloses the microphone 102 and the equalizer device 104 at least partly. A sound opening or sound port 109 is constituted by an opening in the cap 107 which allows pressure variations to enter into the package so as to cause a deflection of the membrane 103. The deflection of the membrane 103 changes the capacitance of the microphone 102 and serves to generate the microphone signal. The sound signal generated by the microphone package 100 is provided at a terminal 111 of the microphone package 100. The equalizer device 104 is coupled to the microphone 102 and to the terminal 111. The equalizer device 104 is implemented in one embodiment as an Application Specific Integrated Circuit (ASIC) and the MEMS microphone 102 is formed on a separate substrate. The MEMS microphone 102 and the ASIC of the equalizer device 104 are both mounted to a common Printed Circuit Board 115 (PCB), which also provides for the external terminal 111. The Printed Circuit Board 115 and the cap 107 forms a common housing which enclose the microphone and the equalizer device at least partly, leaving at least an opening for the sound port 109. The MEMS microphone 102 and the ASIC of the equalizer device 104 may be electrically coupled by means of the Printed Circuit Board 115 or by means of additional circuitry.

In the embodiment of FIG. 8, the microphone 102 and the equalizer device 104 are both sealed by a common sealing compound 113 within the microphone package 100. The sealing compound 113 does, however, not close the sound port 109. The back volume 105 may be hermetically sealed or have a small ventilation channel so as to avoid compression of the air within the back volume 105.

In further implementations, the sound opening 109 may also be formed below the membrane 103, i.e. at the bottom of the package, as for example illustrated in FIG. 9. Further embodiments of packages comprise additional terminals so as to be able to provide a supply voltage and ground connection. This may provide for the possibility to connect all components within the microphone package in one single assembly step to further circuitry, printed circuit boards or the like by means of the terminal(s).

Figure 9:
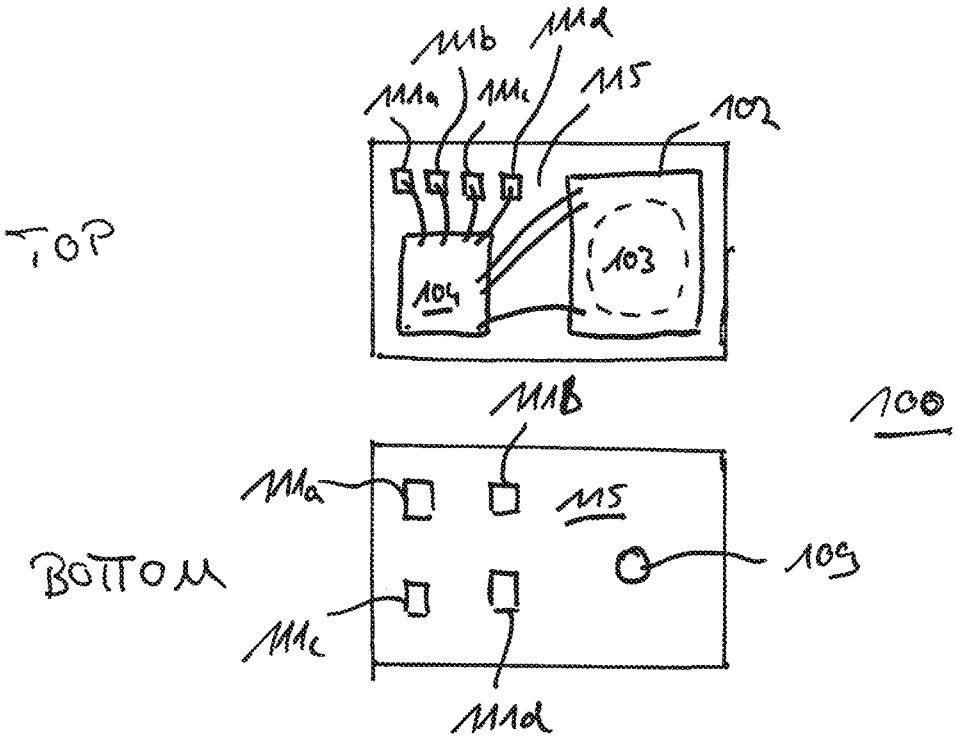
FIG. 9 shows a top- and bottom view of a further embodiment of a microphone package.

FIG. 9 illustrates a top- and bottom view of a further embodiment of a microphone package having a different geometry. The difference between FIG. 9 and the implementation of the embodiment of FIG. 8 is shortly summarized below. The sound port 109 is formed within the PCB 115 in FIG. 9 so that the cap, which is not shown, forms the back volume for the MEMS microphone 102. The terminals 111*a*-111*d* of the microphone package 100 are situated on the bottom of the common PCB 115 which may help to reduce the area the microphone package 100 consumes overall. The MEMS microphone 102 and the ASIC of the equalizer device 104 are electrically coupled by means of bonding wires. The ASIC of the equalizer device 104 and the terminals 111*a*-111*d* are also connected by means of bonding wires. The PCB 115 transfers the terminals 111*a*-111*d* from the inside of the package 100 to the outside of the package 100.

During production of the microphone package 100, the substrate of the MEMS microphone 102 and the equalizer device 104 are attached to the PCB 115 before they are electrically coupled by the bonding wires. Finally, the package may be sealed hermetically by applying the cap from the top side.

A characteristic of the equalizer device may be tuned to fit the MEMS microphone 102 and the particular package design used. Identical MEMS microphones 102 may be used in different package designs providing for a modified microphone signal with similar characteristics or signal-to-noise-ratios. The characteristic or the filter coefficients of the equalizer device 104 may be determined for each combination of a MEMS microphone 102 and a package design, so that appropriately pre-configured equalizer devices may be used within the different combinations.

Alternatively, the equalizer characteristic may be programmable after assembly. Product variations may be compensated for in that a frequency response of the unmodified microphone signal can then be determined after assembly of the package. The equalizer characteristic may then be programmed so that a desired spectral behavior is achieved for the modified microphone signal of each individual package, which may then also account for process variations, e.g. in the processes used to manufacture the MEMS microphone.

The microphone packages according to the previously-described example embodiments may, for example, be used in mobile telecommunication devices as, for example, mobile phones or the like. Any application requiring the recording or monitoring of ambient sound may use microphone packages according to example embodiments. For example, in automotive applications, hands-free car kits may use example embodiments of microphone packages to achieve enhanced sound quality. For example, headsets for call center personnel or the like may further use microphone packages according to an example embodiment in order to increase the signal quality as experienced by a customer of the call center. Generally speaking, microphone packages according to some example embodiments provide additional benefits in any application where ambient sound is to be recorded or monitored or to be further processed by means of further electrical circuitry on a printed circuit board or the like.

Example embodiments may further provide a computer program having a program code stored in a non-transistor storage medium for performing one of the above methods, when the computer program is executed on a computer or processor. A person of skill in the art would readily recognize that steps of various above-described methods may be performed by programmed computers. Herein, some example embodiments are also intended to cover program storage devices, e.g., digital data storage media, which are machine or computer readable and encode machine-executable or computer-executable programs of instructions, wherein the instructions perform some or all of the acts of the above-described methods. The program storage devices may be, e.g., digital memories, magnetic storage media such as magnetic disks and magnetic tapes, hard drives, or optically readable digital data storage media. Further example embodiments are also intended to cover computers programmed to perform the acts of the above-described methods or (field) programmable logic arrays ((F)PLAs) or (field) programmable gate arrays ((F)PGAs), programmed to perform the acts of the above-described methods.

The description and drawings merely illustrate the principles of the disclosure. It will thus be appreciated that those skilled in the art will be able to devise various arrangements that, although not explicitly described or shown herein, embody the principles of the disclosure and are included within its spirit and scope. Furthermore, all examples recited herein are principally intended expressly to be only for pedagogical purposes to aid the reader in understanding the principles of the disclosure and the concepts contributed by the inventor(s) to furthering the art, and are to be construed as being without limitation to such specifically recited examples and conditions. Moreover, all statements herein reciting principles, aspects, and embodiments of the disclosure, as well as specific examples thereof, are intended to encompass equivalents thereof.

Functional blocks denoted as "means for . . . " (performing a certain function) shall be understood as functional blocks comprising circuitry that is configured to perform a certain function, respectively. Hence, a "means for s.th." may as well be understood as a "means configured to or suited for s.th.". A means configured to perform a certain function does, hence, not imply that such means necessarily is performing the function (at a given time instant).

Functions of various elements shown in the figures, including any functional blocks labeled as "means", "means for providing a sensor signal", "means for generating a transmit signal.", etc., may be provided through the use of dedicated hardware, such as "a signal provider", "a signal processing unit", "a processor", "a controller", etc. as well as hardware capable of executing software in association with appropriate software. Moreover, any entity described herein as "means", may correspond to or be implemented as "one or more modules", "one or more devices", "one or more units", etc. When provided by a processor, the functions may be provided by a single dedicated processor, by a single shared processor, or by a plurality of individual processors, some of which may be shared. Moreover, explicit use of the term "processor" or "controller" should not be construed to refer exclusively to hardware capable of executing software, and may implicitly include, without limitation, digital signal processor (DSP) hardware, network processor, application specific integrated circuit (ASIC), field programmable gate array (FPGA), read only memory (ROM) for storing software, random access memory (RAM), and non-volatile storage. Other hardware, conventional and/or custom, may also be included.

It should be appreciated by those skilled in the art that any block diagrams herein represent conceptual views of illustrative circuitry embodying the principles of the disclosure. Similarly, it will be appreciated that any flow charts, flow diagrams, state transition diagrams, pseudo code, and the like represent various processes which may be substantially represented in computer readable medium and so executed by a computer or processor, whether or not such computer or processor is explicitly shown.

Furthermore, the following claims are hereby incorporated into the detailed description, where each claim may stand on its own as a separate example embodiment. While each claim may stand on its own as a separate example embodiment, it is to be noted that—although a dependent claim may refer in the claims to a specific combination with one or more other claims—other example embodiments may also include a combination of the dependent claim with the subject matter of each other dependent or independent claim. Such combinations are proposed herein unless it is stated that a specific combination is not intended. Furthermore, it is intended to include also features of a claim to any other independent claim even if this claim is not directly made dependent to the independent claim.

It is further to be noted that methods disclosed in the specification or in the claims may be implemented by a device having means for performing each of the respective acts of these methods.

Further, it is to be understood that the disclosure of multiple acts or functions disclosed in the specification or claims may not be construed as to be within the specific order. Therefore, the disclosure of multiple acts or functions will not limit these to a particular order unless such acts or functions are not interchangeable for technical reasons. Furthermore, in some embodiments a single act may include or may be broken into multiple sub acts. Such sub acts may be included and part of the disclosure of this single act unless explicitly excluded.

What is claimed is:

1. A microphone package, comprising:

a microphone configured to generate a microphone signal;

an analog-to-digital converter (ADC) circuit configured to receive the microphone signal or a signal associated therewith, and generate a digital microphone signal based thereon, wherein the digital microphone signal comprises a multi-bit signal;

an equalizer circuit configured to receive the digital microphone signal and alter a frequency response thereof in digital domain, resulting in a modified digital microphone signal; and a modulator coupled to an output of the equalizer circuit and configured to convert the modified digital microphone signal from a multi-bit signal to a single bit representation of the modified digital microphone signal.

2. The microphone package of claim 1, further comprising:

a common housing enclosing the microphone and the equalizer circuit at least partly.

3. The microphone package of claim 2, wherein both the microphone and the equalizer circuit within the housing reside on a substrate.

4. The microphone package of claim 3, wherein the substrate comprising a printed circuit board (PCB).

5. The microphone package of claim 3, further comprising a sealing compound enclosing a portion of the microphone and an entirety of the equalizer circuit.

6. The microphone package of claim 3, further comprising a sound port in the housing to enable pressure variations at a membrane of the microphone within the housing.

7. The microphone package of claim 1, wherein the equalizer circuit altering the frequency response comprises the equalizer circuit being configured to reduce a resonant component within the frequency response of the digital microphone signal.

8. The microphone package of claim 1, wherein the equalizer circuit comprises a digital finite impulse response (FIR) filter configured to alter the frequency response of the digital microphone signal in the digital domain.

9. The microphone package of claim 8, wherein the FIR filter comprises a third order FIR filter configured to approximate an inverse of a resonant component of the frequency response of the digital microphone signal.

10. The microphone package of claim 9, wherein the ADC circuit comprises a sampling frequency input configured to receive a variable sampling frequency signal, wherein the ADC circuit is configured to output the digital microphone signal at one of a plurality of different sampling frequencies.

11. The microphone package of claim 1, further comprising an amplifier circuit coupled between the microphone and the ADC circuit, wherein the amplifier circuit is configured to receive the microphone signal and output an amplified version thereof.

12. The microphone package of claim 1, wherein the microphone comprises a micro-electro-mechanical-system (MEMS).

13. The microphone package of claim 1, wherein the equalizer circuit is configured to attenuate a first frequency portion of the microphone signal within an interval starting at 15 kHz and ending at 20 kHz relative to a second frequency portion starting at 1 kHz and ending at 5 kHz.

14. An audio processing device, comprising:

a microphone package configured to output a modified digital microphone signal, comprising:

a microphone configured to generate a microphone signal; and an analog-to-digital converter (ADC) circuit configured to receive the microphone signal or a signal associated therewith, and generate a digital microphone signal based thereon, wherein the digital microphone signal comprises a multi-bit signal;

an equalizer circuit configured to receive the digital microphone signal and alter a frequency response thereof in digital domain, resulting in a modified digital microphone signal;

wherein the equalizer circuit is configured to modify the digital microphone signal such that a signal-to-noise ratio (SNR) of the modified digital microphone signal is increased; and a modulator coupled to an output of the equalizer circuit and configured to convert the modified digital microphone signal from a multi-bit signal to a single bit representation of the modified digital microphone signal.

15. The audio processing device of claim 14, further comprising:

a common housing enclosing the microphone, the ADC circuit and the equalizer circuit at least partly.

16. The audio processing device of claim 15, further comprising:

a printed circuit board on which the microphone, the ADC circuit and the equalizer circuit reside.

17. The audio processing device of claim 16, further comprising an encapsulation material partly encapsulating the microphone and entirely encapsulating the microphone within the common housing.

18. The audio processing device of claim 16, further comprising a single supply voltage terminal on the printed circuit board, the single supply terminal configured to receive a common supply voltage for the microphone and the equalizer circuit.

19. The audio processing device of claim 14, wherein the equalizer circuit altering the frequency response comprises the equalizer circuit being configured to reduce a resonant component within the frequency response of the digital microphone signal.

20. The audio processing device of claim 14, wherein the equalizer circuit comprises a digital finite impulse response (FIR) filter configured to alter the frequency response of the digital microphone signal in the digital domain.

21. The audio processing device of claim 20, wherein the FIR filter comprises a third order FIR filter configured to approximate an inverse of a resonant component of the frequency response of the digital microphone signal.

22. The audio processing device of claim 21, wherein the ADC circuit comprises a sampling frequency input configured to receive a variable sampling frequency signal, wherein the ADC circuit is configured to output the digital microphone signal at one of a plurality of different sampling frequencies.

23. The audio processing device of claim 14, further comprising an amplifier circuit coupled between the microphone and the ADC circuit, wherein the amplifier circuit is configured to receive the microphone signal and output an amplified version thereof.

* * * * *